US007792442B2

(12) United States Patent
Izawa et al.

(10) Patent No.: US 7,792,442 B2
(45) Date of Patent: Sep. 7, 2010

(54) ELECTRONIC PHOTOGRAPH PRINTER

(75) Inventors: Hideo Izawa, Sakura (JP); Yasushi Katagiri, Kashiwa (JP); Osamu Ebuchi, Funabashi (JP)

(73) Assignee: Miyakoshi Printing Machinery Co., Ltd. (JP)

( * ) Notice: Subject to any disclaimer, the term of this patent is extended or adjusted under 35 U.S.C. 154(b) by 0 days.

(21) Appl. No.: 12/369,481

(22) Filed: Feb. 11, 2009

(65) Prior Publication Data

US 2009/0208231 A1 Aug. 20, 2009

(30) Foreign Application Priority Data

Feb. 15, 2008 (JP) ..... 2008-034712

(51) Int. Cl.
*G03G 15/00* (2006.01)

(52) U.S. Cl. ..... 399/49

(58) Field of Classification Search ..... 399/49, 399/60, 72

See application file for complete search history.

(56) References Cited

U.S. PATENT DOCUMENTS

| | | | | |
|---|---|---|---|---|
| 5,307,119 | A | 4/1994 | Folkins et al. | |
| 5,448,277 | A | 9/1995 | Long | |
| 6,650,848 | B1 * | 11/2003 | Regelsberger et al. | 399/49 |
| 6,934,480 | B2 * | 8/2005 | Shim et al. | 399/49 |

FOREIGN PATENT DOCUMENTS

| | | | |
|---|---|---|---|
| EP | 1262749 | A2 | 12/2002 |
| JP | 59-22060 | A | 2/1984 |
| JP | 7-333923 | A | 12/1995 |
| JP | 2002-307745 | A | 10/2002 |
| JP | 2003-122129 | A | 4/2003 |
| JP | 2003-175661 | A | 6/2003 |
| JP | 2004-101564 | A | 4/2004 |
| JP | 2005-326764 | A | 11/2005 |
| JP | 2006-189602 | A | 7/2006 |

OTHER PUBLICATIONS

Japanese Office Action for Japanese Patent Application No. 2008-034712 mailed Dec. 15, 2009 with English Translation.
European Search Report for Application No./Patent No. 09152522.0-2209/2096501 issued Aug. 5, 2009.
Japanese Office Action for Application No. JP2008-034712 mailed Mar. 30, 2010 with English translation.

* cited by examiner

*Primary Examiner*—Hoang Ngo
(74) *Attorney, Agent, or Firm*—Cantor Colburn LLP

(57) ABSTRACT

A electronic photograph printer includes a density-measurement section and a density controller section. The density-measurement section includes a density sensor 31 for measuring densities of images printed on a web by electronic-photograph-printing units. The density controller section adjusts densities of images which are about to be printed on the web by the electronic-photograph-printing units based on measurement data obtained by using the density sensor 31 associated with the densities of the image on the web. This configuration enables accurate and stable print-density control at a low cost.

9 Claims, 4 Drawing Sheets

ELECTRONIC PHOTOGRAPH PRINTER

The present application is based on patent application No. 2008-034712 filed in Japan on Feb. 15, 2008, the content of which is incorporated herein by reference.

BACKGROUND OF THE INVENTION

1. Field of the Invention

The present invention relates to wet electronic photograph printers using liquid toner including toner grains dispersed in carrier liquid, and in particular, relates to electronic photograph printers having a print-density-controlling function.

2. Description of the Related Art

Technology associated with print-density control for electronic photograph printers using liquid-toner (hereinafter simply called toner) and commonly known is disclosed, for example, in Patent Document 1.

In the technology disclosed in Patent Document 1, the average density of a toner image formed on the surface of a photosensitive drum with a plurality of photo-sensors with reference to a wide reference density patch to maintain the image density by controlling the development bias of a developer apparatus while comparing the average density with a reference value.

This technology enables automatic setting of an initial value for voltage applied onto an anilox roll (toner supplier roll) used in the developer apparatus. In addition, if the density in the reference density patch is not uniform partly because static-charging devices or optical components deteriorate or are soiled partly in their width direction, the image density can be maintained appropriately because the development bias is set to have the average density.

[Patent Document 1] Japanese Unexamined Patent Application, First Publication No. S59-22060

However, the density of the toner image on the surface of the photosensitive drum differs from the density of an image transferred onto the web. Therefore, the technology disclosed in the aforementioned Patent Document 1 does not ensure accurate density control.

In addition, measurement for the density of the toner image is costly because the number of photo-sensors used for the measurement tends to increase in proportion to the number of divided sections of the toner image in an attempt to minimize the width in each session of measuring the density.

SUMMARY OF THE INVENTION

An object of the present invention in view of the aforementioned circumstances is to provide an electronic photograph printer capable of accurate and stable print-density control at low cost.

In an attempt to solve the aforementioned problems, the present invention provides the following configuration.

A first invention provides a multi-color-liquid-toner electronic photograph printer including: electronic-photograph-printing units for printing images on a web; a density sensor for measuring densities of images printed by the electronic-photograph-printing units at a plurality of points in a width direction of the web at downstream in the feeding direction of the web relative to the electronic-photograph-printing units, a density-measurement section for moving the density sensor in the width direction of the web; and a density controller section for comparing an average value for the densities of the images measured by the density sensor with preset reference density values, and for causing densities of images which are about to be printed on the web by the electronic-photograph-printing units to coincide with the reference density values.

A second invention provides the electronic photograph printer according to the first invention, which further includes a sensor-movement-control section for controlling driving states of the electronic-photograph-printing units. The density-measurement section is capable of setting a plurality of image-density-measurement points, at which the density sensor suspends its sensing movement, at the plurality of points in the width direction of the web in accordance with an instruction put into the sensor-movement-control section, and moves the density sensor in the width direction of the web while ensuring that the density sensor suspends its sensing movement for a preset suspension time at each image-density-measurement point.

A third invention according to the second invention provides the electronic photograph printer which further includes an operation terminal for inputting an instruction for setting the plurality of image-density-measurement points and for supplying the instruction to the sensor-movement-control section.

A fourth invention according to one of the second and third inventions provides the electronic photograph printer in which the sensor-movement-control section has an automatic function of setting the image-density-measurement points in accordance with a printing width with which the electronic-photograph-printing units are currently printing.

A fifth invention according to the first invention provides the electronic photograph printer, in which one of the electronic-photograph-printing units prints a band-shaped density-controlling patch extending in the width direction of the web, and the density-measurement section controls the densities of images which are about to be printed on the web by the electronic-photograph-printing units in accordance with the densities of the density-controlling patches measured by the density sensor at the plurality of points in the width direction of the web.

A sixth invention provides a printing method using the electronic photograph printer of the present invention, including the steps of: setting the reference density value for each color, printing each color of the density-controlling patch so that the density-controlling patches are shifted with respect to the longitudinal direction of the web; measuring the density of each color of the corresponding density-controlling patch by using the density sensor at the plurality of points in the width direction of the web; and controlling the density of each color which is about to be printed on the web by the corresponding electronic-photograph-printing unit by using the density-measurement section so that the average value for the image densities measured by the density sensor is equal to the preset reference density value.

A seventh invention according to the sixth invention provides the printing method according to the sixth invention, further including the steps: printing the density-controlling patches automatically when the quantity of the web supplied to the electronic-photograph-printing units reaches a preset value; and suspending the printing operation automatically after the density-controlling patches have been printed.

An eighth invention according to the seventh invention provides the printing method according to the seventh invention, further including the step of measuring the densities of the images automatically by using the density sensor after the density-controlling patches have been printed.

EFFECT OF THE INVENTION

The electronic photograph printer according to the present invention controls the densities of images printed on the web by the electronic-photograph-printing units based on the densities of images having been measured at a plurality of points in the width direction of the web by the density sensor so that the average value thereof is equal to the preset reference density values. In this configuration, the densities of the images are controlled based on the densities of the images of the density-controlling patches that have been actually printed on the web. Therefore, the present invention ensures more accurate and stable density control than those of conventional cases. Therefore, the present invention ensures accurate and stable density control regardless of the properties of liquid toner, the properties of a web, the feeding rate for the web, etc.

In addition, the present invention ensures measurement of densities at more reduced cost than a conventional case using a plurality of sensors since the densities of images are measured by moving the density sensor in the width direction of the web at a plurality of points in the width direction of the web. In addition, the present invention can facilitate setting of the measurement positions in accordance with various printing conditions including printing width and printing quality or the like since measurement of densities using the density sensor moving in the width direction of the web enables arbitrary setting of the measurement positions (image-density-measurement points) in the width direction of the web. Therefore, the number of image-density-measurement points in the width direction of the web can be set arbitrarily. Furthermore, reliable density measurement can be conducted in accordance with various printing conditions including printing width and printing quality or the like.

DETAILED DESCRIPTION OF THE INVENTION

An example of an electronic photograph printer as an implementation of the present invention will be explained as follows with reference to drawings.

Figure 1:
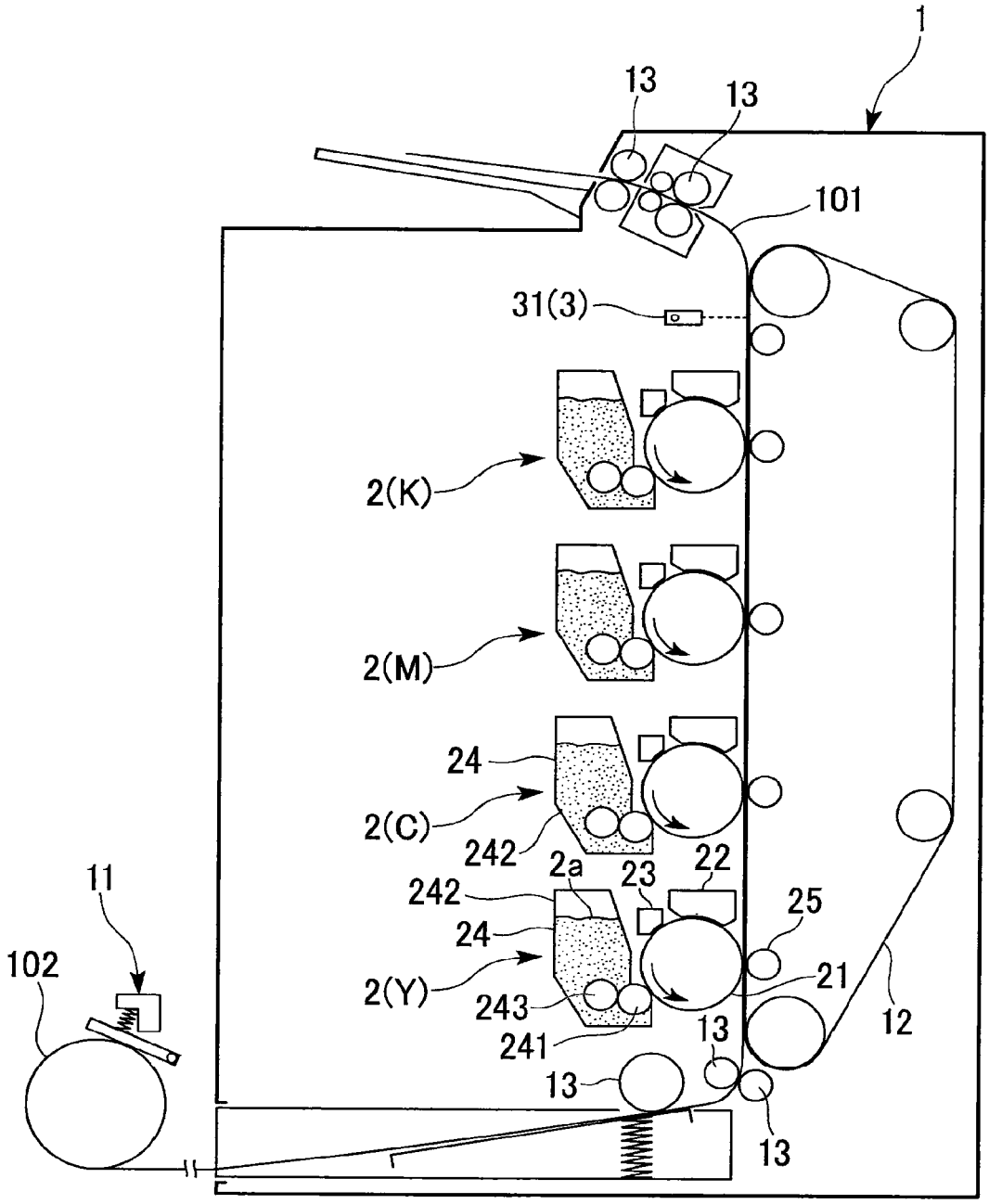
FIG. 1 is an overall view showing an embodiment of an electronic photograph printer according to the present invention.
Figure 2:
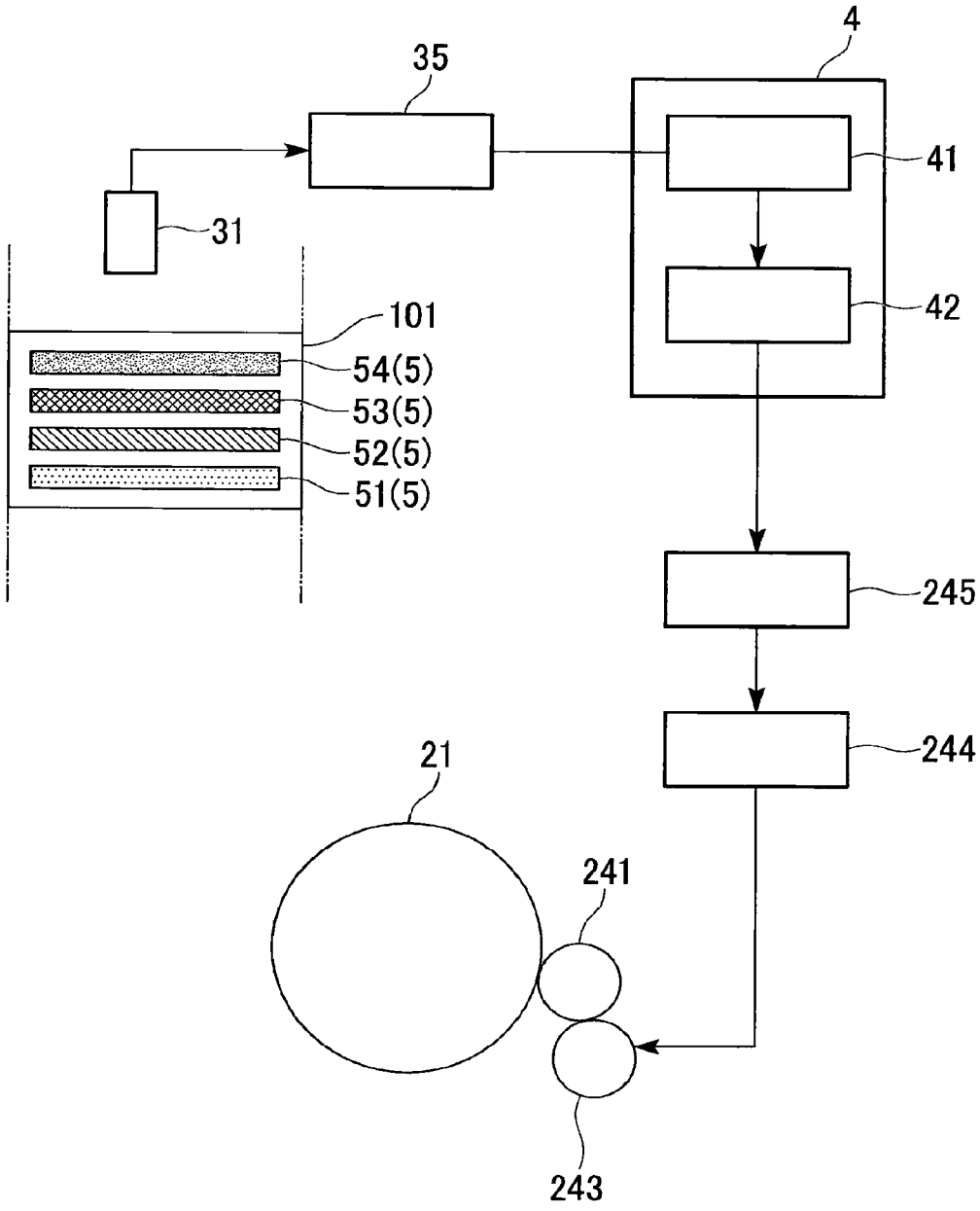
FIG. 2 is a block diagram for explaining a density-control system for the electronic photograph printer shown in FIG. 1.
Figure 3:
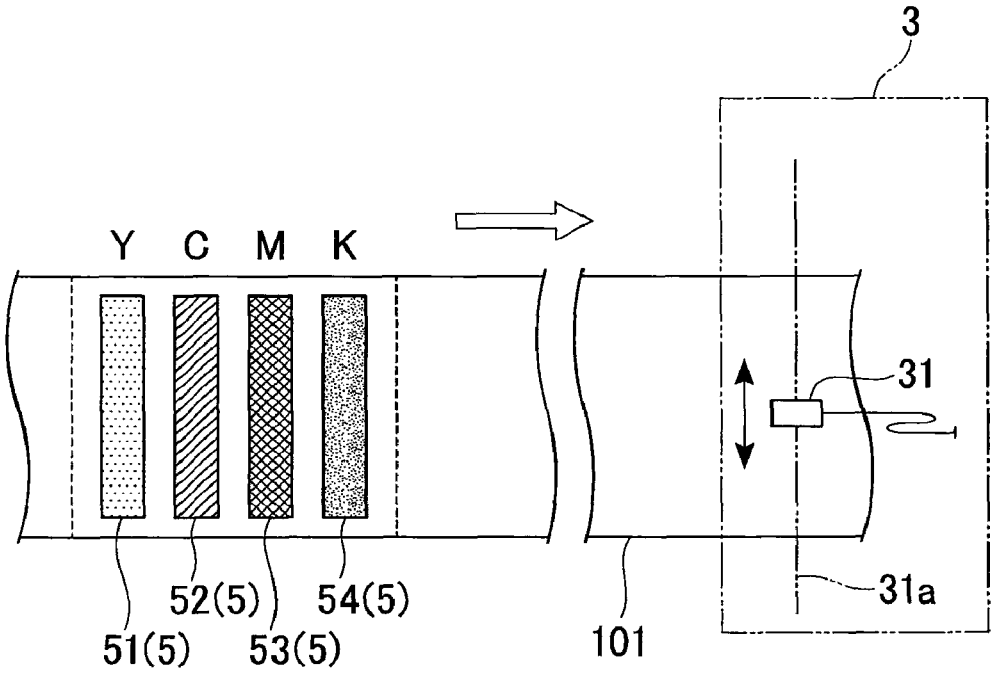
FIG. 3 shows a density-controlling patch printed on a web by using the electronic-photograph-printing unit of the electronic photograph printer.
Figure 4:
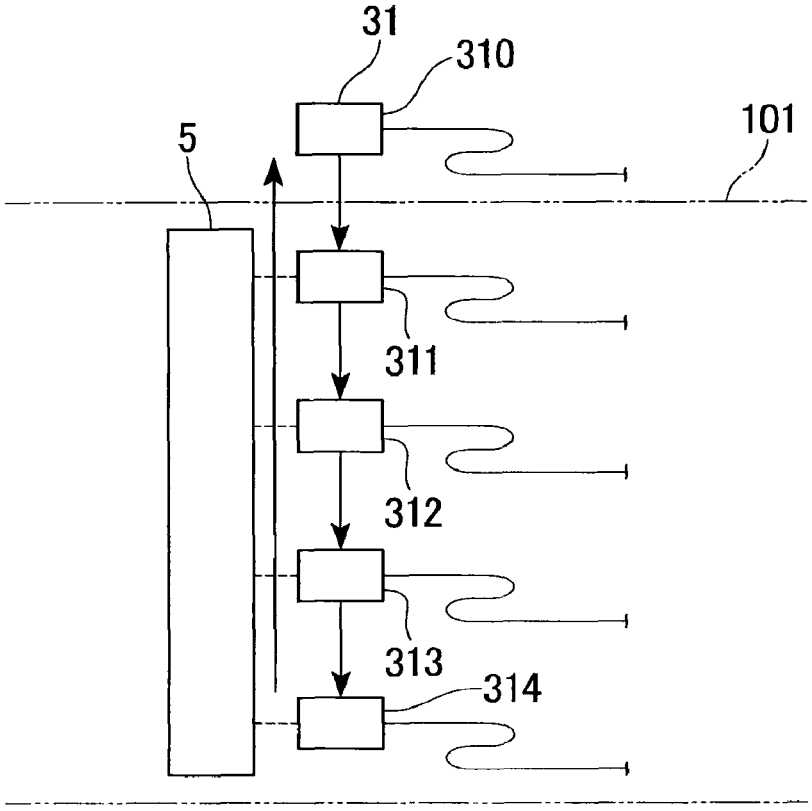
FIG. 4 shows the movements of the density sensor of the electronic-photograph-printing unit that measures the image density.
Figure 5:
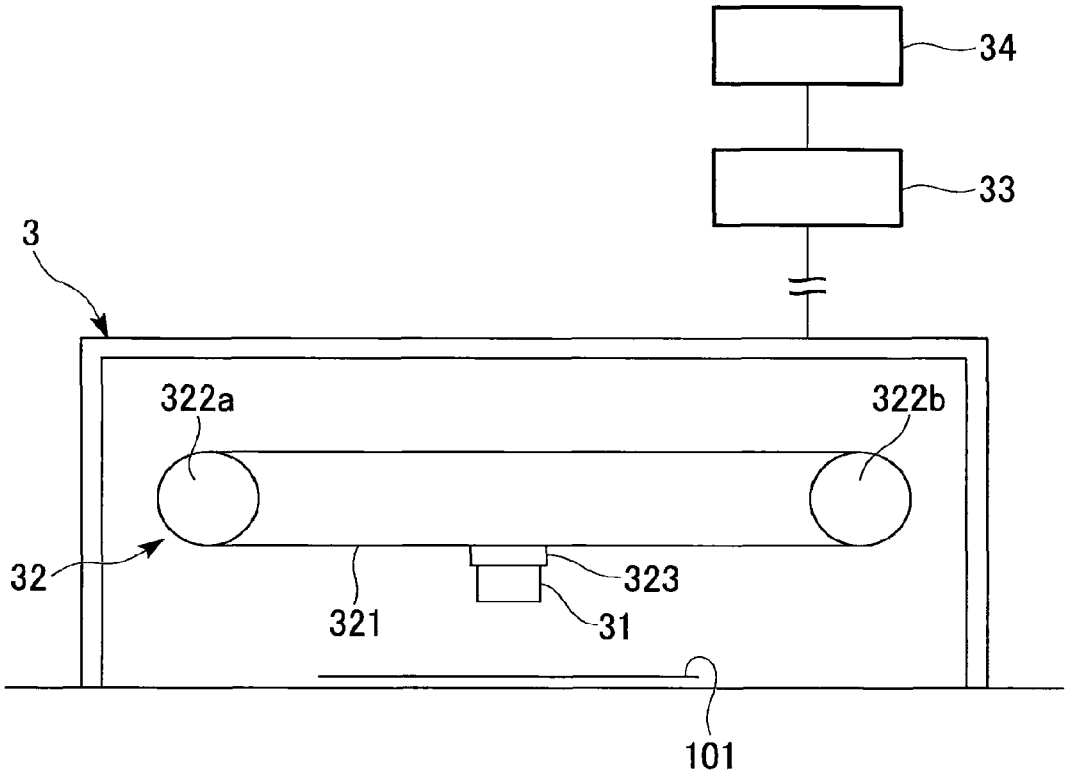
FIG. 5 is a schematic view showing the structure of the density-measurement section which moves the density sensor in the width direction of the web and measures the densities of the images printed on the web.

FIG. 1 is an overall view showing the configuration of an electronic photograph printer 1 according to the present invention. FIG. 2 is a block diagram for explaining the density-control system of the electronic photograph printer 1. FIG. 3 shows a density-controlling patches printed on a web by using a electronic-photograph-printing units 2 of the electronic photograph printer 1. FIG. 4 shows the movements of the density sensor of the electronic-photograph-printing unit 1 that measures the densities of images. FIG. 5 is a schematic view showing the structure of the density-measurement section which moves the density sensor in the width direction of the web and measures the densities of the images printed on the web.

The following explanation is based on the precondition that, in FIG. 1, components shown in an upper section of the drawing are disposed at a somewhat distant location from a floor line, and components shown in a lower section of the drawing is disposed on the floor or close to the floor line.

As shown in FIGS. 1 and 2, the electronic photograph printer 1 includes: a plurality of electronic-photograph-printing units 2 for conducting multi-color printing; a density-measurement section 3 for measuring the densities of the images printed on a web 101 which has passed through the electronic-photograph-printing units 2; and a density controller section 4 for controlling a driving state of the electronic-photograph-printing units 2 based on the measurement data obtained by measuring the densities of the images printed on the web 101 by using a density sensor 31 provided in the density-measurement section 3, and for adjusting the densities of the images printed on the web 101 by the electronic-photograph-printing units 2.

Each electronic-photograph-printing unit 2 is a wet electronic photograph printer using liquid toner 2*a* (hereinafter simply called toner) obtained by dispersing toner grains in carrier liquid.

Electronic photograph printers having commonly known configurations may be adopted for the electronic-photograph-printing unit 2 which prints an image on the web 101 by forming a static latent image on the surface of a photosensitive drum 21 by using exposure light; forming a toner image by visualizing the static latent image by using the toner; and by transferring the toner image onto the web 101.

Reference numeral 22 in FIG. 1 indicates a static-charging apparatus for providing static electric charge onto the surface of the photosensitive drum 21 uniformly. Reference numeral 23 indicates an exposure apparatus for forming a static latent image by removing static electric charge provided on the surface of the photosensitive drum 21 by the static-charging apparatus 22 by using exposure light. Reference numeral 24 indicates developer apparatuses for supplying toner 2*a* onto the photosensitive drum 21 and forming a toner image on the surface of the photosensitive drum 21 by visualizing the static latent image. Reference numeral 25 indicates a backup roll for pressing the web 101 onto the photosensitive drum 21.

Each developer apparatus 24 includes: a rotative developing roll 241 making contact with the photosensitive drum 21; a tank 242 for storing the toner 2*a*; and a rotative anilox roll 243 making contact with the developing roll 241 and supplying the toner 2*a* stored in the tank 242 to the developing roll 241. Subsequently, the toner transferred and supplied from the anilox roll 243 to the developing roll 241 is further supplied to the photosensitive drum 21.

Needless to say, the electronic-photograph-printing units 2 according to the present invention may adopt an intermediate-transfer component including a transfer roll provided between the photosensitive drum 21 and the web 101 for transferring the toner image formed on the surface of the photosensitive drum 21 onto the web 101.

Each electronic-photograph-printing unit 2 provided in the electronic photograph printer 1 conducts a different color of printing.

The example shown in the drawing has adopted an elongated swath of the web 101.

The electronic photograph printer 1 conducts multi-color printing by feeding the web 101 into the electronic-photograph-printing units 2, each of which conducts a different color printing one by one in the electronic photograph printer 1.

To be more specific, the electronic photograph printer 1 according to the present embodiment includes four electronic-photograph-printing units 2.

In addition, the four electronic-photograph-printing units 2 are arranged so that four printing colors including yellow, magenta, cyan, and black are disposed in this order from the upstream to the downstream with respect to the feeding direction of the web 101.

Reference symbols Y, M, C, and K added to each electronic-photograph-printing unit 2 shown in FIG. 1 are abbreviations provided to four printing colors of yellow, magenta, cyan, and black respectively. The abbreviations of Y, M, C, and K may be used to explain each printing color of the corresponding electronic-photograph-printing unit 2 in the present specification.

It should be noted that the order for arranging the printing colors of the electronic-photograph-printing units 2, which is not limited to the configuration shown in FIG. 1, may be changed if necessary.

In addition, all the electronic-photograph-printing units 2 print images on the same side of the web 101.

In FIGS. 2 and 3, the abbreviations of Y, M, C, and K are added corresponding to printing colors of the density-controlling patches 5 which will be explained later. The abbreviations of Y, M, C, and K may be used to explain each printing color of the corresponding density-controlling patch 5 in the present specification.

Each density-controlling patch corresponding to each one of the four colors of Y, M, C, and K is formed by the corresponding printing color of electronic-photograph-printing unit 2.

In the drawings, the electronic photograph printer 1 has a plurality of (four sets in the example shown in the drawings) vertical multi-staged electronic-photograph-printing units 2.

The electronic photograph printer 1 ensures multi-color printing by feeding the web 101 through the vertical multi-staged electronic-photograph-printing units 2 one by one in the longitudinal direction with respect to the electronic photograph printer 1 (in the example shown in the drawings, by feeding the web 101 upwardly from the lowest one of the electronic-photograph-printing unit 2).

Reference numeral 12 indicates a rotative endless belt for assisting the feeding movement of the web 101. In addition, reference numeral 13 indicates guide rolls for feeding the web 101.

The electronic photograph printer 1 explained here automatically prints the band-shaped density-controlling patches 5 extending in the width direction of the web 101 onto the web 101 by using the electronic-photograph-printing units 2 as shown in FIGS. 2 and 3 when the quantity of the web supplied to the electronic-photograph-printing units 2*a* reaches a preset value, and the electronic photograph printer 1 upon finishing printing the density-controlling patches 5 automatically suspends the printing of the density-controlling patches 5. Subsequently, the density-measurement section 3 is driven to measure the densities of the density-controlling patches 5 by using the density sensor 31 automatically and to automatically adjust the densities of the images printed on the web 101 by the electronic-photograph-printing units 2 based on the measured density values obtained in the aforementioned measuring of the image densities.

The controller apparatus which controls driving of the electronic photograph printer 1 as a whole monitors the quantity of the web 101 supplied to the electronic-photograph-printing units 2 by, for example, measuring the outer diameter size of a textile stuff 102 obtained by rolling up the elongated swath of web 101, or by using a rotative roll, having a counter, making contact with the web 101 fed from the textile stuff 102. When the feeding amount reaches a preset value, an instruction put out from the controller apparatus causes the density-controlling patches 5 to be printed, and then, various operations including stopping automatic printing movement, measuring the density of printed image, and adjusting the density of printed image are conducted.

Reference numeral 11 indicates a sensor for measuring the outer diameter of the textile stuff 102 and measuring the feed amount of the web 101.

In case that a cutter machine is provided adjacent to the electronic photograph printer 1 for shaping the web 101 that has undergone printing in the electronic photograph printer 1 and has been fed out from there into a predetermined size of flat sheets, the feed amount of the web 101 may be monitored based on the number of pieces of flat sheets shaped by the cutter machine.

An arbitrary preset value may be set associated with the feed amount of web 101 for carrying out printing of the density-controlling patches 5. For example, if the preset value is set to indicate that the web 101 fed from the textile stuff 102 remains small, adjusting the electronic photograph printer 1 based on the resultant density-controlling patch 5 and exchanging the textile stuff 102 can be conducted simultaneously.

Each density-controlling patch 5 is formed by the corresponding electronic-photograph-printing unit 2.

The electronic photograph printer 1 prints each band-shaped density-controlling patch 5 having the corresponding color and extending in the width direction of the web 101 so that the density-controlling patches 5 are shifted in the longitudinal direction of the web 101.

Referring to the example shown in the drawing, the electronic photograph printer 1 forms four density-controlling patches 5 in parallel by using four electronic-photograph-printing units 2. For example, the four density-controlling patches 5 are printed within a 12-inch-size formpaper in this configuration. Each density-controlling patch 5 is formed by the corresponding electronic-photograph-printing unit 2 alone.

In the drawing, reference numerals 51 to 54 are added, to increase distinction, to four density-controlling patches 5 corresponding to the four colors of Y, M, C, and K, respectively. The color of the density-controlling patch indicated by reference numeral 51 corresponds to Y; the color of the density-controlling patch indicated by reference numeral 52 corresponds to M; the color of the density-controlling patch indicated by reference numeral 53 corresponds to C; and the color of the density-controlling patch indicated by reference numeral 54 corresponds to K.

(Density-Measurement Section)

The density-measurement section 3 is disposed downstream in the feeding direction of the web 101 relative to the electronic-photograph-printing units 2 in the electronic photograph printer 1. To be more specific, the density-measurement section 3 is disposed downstream relative to the most downstream one of the electronic-photograph-printing units 2 (referring to the drawing, the electronic-photograph-printing unit 2 corresponding to print color K) in the feeding direction of the web 101.

Referring to FIGS. 3 and 4, the density-measurement section 3 measures the densities of the images printed on the web 101 by moving the density sensor 31 in the width direction of the web 101 (i.e., a sidelay-like movement indicative of the movement of a component such as a sensor moving in the width direction of the web).

The density sensor 31 is a non-contact optical densitometer.

The density-measurement section 3 includes the density sensor 31 and a sensor-moving mechanism 32 for moving the density sensor 31 in the width direction of the web 101. (See, for example, the sensor-moving mechanism 32 shown in FIG. 5.)

Reference numeral 33 shown in FIG. 5 indicates a sensor-movement-control section 33 for controlling a driving state of the sensor-moving mechanism 32. In addition, as shown in FIG. 5, an operation terminal 34 (for example, an operation panel) for inputting an instruction for the sensor-movement-control section 33 is connected to the sensor-movement-control section 33.

In addition, the density-measurement section 3 measures the densities of the images printed on the web 101 at a plurality of points in the width direction of the web 101 by moving the density sensor 31 along the printed surface (i.e., the surface onto which the image is printed by the electronic-photograph-printing units 2) of the web 101 in the width direction of the web 101. (That is, measurement movement is carried out.)

Although sensor-movement-control section 33 used herein constitutes a part of the controller apparatus for controlling the driving state of the whole electronic photograph printer 1, it may be provided separately from the controller apparatus.

As shown in FIG. 4, the density sensor 31 disposed in the density-measurement section 3 starts its movement from an origin point position 310 set in the exterior of the surface of the web 101 which is subject to printing, and returns to the origin point position 310 via image-density-measurement points 311 to 314 that have been preset at a plurality of points in the width direction of the web 101.

However, the density sensor 31 suspends its movement at the image density measurement points 311 to 314 for a preset period of suspension time. The density sensor 31 measures the densities of the images printed on the web 101 during the suspension time.

The origin point position 310 and the image density measurement points 311 to 314 are arranged in an array. The density sensor 31 for conducting measurement for the densities upon starting its movement from the origin point position 310 suspends the movement at the image-density-measurement points 311 to 314 in this order in view of proximity with respect to the origin point position 310. After the lapse of the preset suspension time, the density sensor 31 moves to an adjacent image-density-measurement point away from the origin point position 310 to measure the densities. That is, the measurement for the densities conducted by the density sensor 31 is shifted to the adjacent image-density-measurement point one by one that is away from the origin point position 310. Eventually, the density sensor 31 reaches the image-density-measurement point that is farthest from the origin point position 310 (in FIG. 4, the image-density-measurement point indicated as reference numeral 314), and then moves to the origin point position 310 after the lapse of predetermined suspension time.

The movement of the density sensor 31 in the density-measurement section 3 is not limited to the aforementioned configuration.

For example, in another adoptable configuration, the density sensor 31, upon reaching the farthest one the image-density-measurement points indicated by reference numeral 314, suspends its movement, and after the lapse of predetermined suspension time, density sensor 31 measures densities from the farthest one to the closest one of the image-density-measurement points one by one with respect to the origin point position 310, and then, the density sensor 31 returns to the origin point position 310.

In further adoptable configuration, the density is measured first at the farthest one of the image-density-measurement points indicated by reference numeral 314 with respect to the origin point position 310; and then the densities are measured one by one at the adjacent image-density-measurement point toward the origin point position 310, before the density sensor 31 returns to the origin point position 310.

Although the movement of the density sensor 31 for measuring the densities should cover all the image-density-measurement points 311 to 314 in the density-measurement section 3, an arbitrary order may be set to the image-density-measurement points 311 to 314 for measuring the densities there as long as the movement of the density sensor 31 is suspended for the preset suspension time at the image-density-measurement points 311 to 314.

In addition, the present invention is not limited to the configuration in which the origin point position 310 is set at a position in the exterior of the surface of the web 101 that is subject to printing. For example, the origin point may be set at one of the image density measurement points 311 to 314.

Alternatively, two standby positions may be provided across the web 101 so that the density sensor 31 upon starting movement from one of the standby positions measures the densities at all the image density measurement points 311 to 314 and then suspends the movement at the other standby position.

The density-controlling patches 5 used in the multi-color electronic photograph printer 1 and formed on the web 101 are shifted in the longitudinal direction of the web 101. In this configuration, the densities of all the density-controlling patches 5 are measured from the most downstream one of the density-controlling patches 5 with respect to the feeding direction of the web toward the upstream side one by one.

In this state of the electronic photograph printer 1, the position of a movement line 31*a* of the density sensor 31 making linear sidelay-like movement in the density-measurement section 3 is fixed. The alignment between the density-controlling patches 5 and the density sensor 31 (more specifically, the alignment between the density-controlling patch 5 and the movement line 31*a* of the density sensor 31) are ensured by the feeding movement of web.

The present invention is not limited to the aforementioned configuration. For example, in another adoptable configuration as shown in FIG. 5, the sensor-moving mechanism 32 moves along the longitudinal direction of the web after suspending the printing operation, and then alignment is obtained between the density-controlling patches 5 and the density sensor 31 (more specifically, between the density-controlling patches 5 and the movement line 31*a* of the density sensor 31).

FIG. 5 shows an example of the density-measurement section 3.

FIG. 5 shows the sensor-moving mechanism 32 of the density-measurement section 3, in which an endless belt 321 is put over and stretched around two pulleys 322*a* and 322*b* disposed away from each other, and the density sensor 31 is fixed onto a sensor-fixing member 323 attached to the endless belt 321. In this configuration, driving and rotating at least one of the two pulleys 322*a* and 322*b* causes the endless belt 321 to go round, thereby moving the density sensor 31.

However, the sensor-moving mechanism 32, not limited to the example using an endless belt mechanism as shown in FIG. 5, may adopt other various forms of mechanisms as long as they ensure sidelay-like movement of the density sensor 31 in the width direction of the web 101.

In this configuration, the density sensor 31 used herein is capable of measuring the density of each color corresponding to the density-controlling patch 5 printed by the corresponding electronic-photograph-printing unit 2 provided in the electronic photograph printer 1; and the number of units of the density sensor 31 provided to the density-measurement section 3 is one. In another adoptable configuration, the sensor-moving mechanism 32 may be capable of moving the density sensors corresponding to different colors that are subject to measurement for the image densities at a time. Multi-color printing using five or more colors can be achieved by using a plurality of density sensors each using the corresponding different color which will be subject to measurement of image density.

The density-measurement section 3 in this case as shown in FIG. 5 enables the sidelay-like movements of the density sensors at a time by fixing the density sensors each corresponding to a different color, which will be subject to measurement of image density, onto the sensor-fixing member 323 attached to the endless belt 31 of the sensor-moving mechanism 32.

Inputting instructions to the operation terminal 34 allows a plurality of image-density-measurement points to be set separately that are subject to measurement using the density-measurement section 3. Previously-input positions can be reset to other positions by inputting a new instruction into the operation terminal 34. The number for the image-density-measurement points can be increased or decreased.

Selectivity for image-density-measurement points enables optimization for measurement of density in view of the width of print in the width direction of the web 101 and necessary printing quality or the like. In an adoptable configuration, more numerous image-density-measurement points may be set for a region (that is, the image-density-measurement points are disposed densely) in which a significant part of printing image is distributed unevenly with respect to the width direction of the web.

In addition, it is preferable that the electronic photograph printer 1 should include a function of setting the image-density-measurement points automatically in accordance with the width of an image printed by the electronic-photograph-printing units 2.

In this configuration, the sensor-movement-control section 33 automatically sets a preset number of the image-density-measurement points at regular intervals in accordance with the width of an image, which will be printed by the electronic-photograph-printing units 2, put into the controller apparatus for controlling a driving state of the whole electronic photograph printer 1. Furthermore, in this configuration, the image-density-measurement points can be adjusted separately and their number of points can be increased or decreased in accordance with an instruction put into the operation terminal 34 if necessary after the aforementioned automatic setting of the number of the points. This facilitates separate adjustment of the image-density-measurement points in accordance with the printing width; and increasing or decreasing of the number of points. In addition, the printing width can be modified flexibly. In another adoptable configuration, the sensor-movement-control section 33 may automatically set a preset number of the image-density-measurement points in accordance with the width of an image preset in view of the width of web.

(Density-Control Section and Movement for Controlling Image Density)

Operations for controlling the image density conducted by the density controller section 4 and the electronic photograph printer 1 will be explained next.

The density controller section 4 shown in FIG. 2 calculates for the image densities measured by the density sensor 31 of the density-measurement section 3 at the image-density-measurement points in the width direction of the web; compares the average with a preset reference density value; and causes the density of image, which will be printed onto the web 101 by the electronic-photograph-printing units 2, to coincide with the reference density value.

The density controller section 4 used herein may constitute a part of the controller apparatus for controlling the driving state of the whole electronic photograph printer 1, or may be provided separately from the controller apparatus.

As shown in FIG. 2, the density controller section 4 includes a computation-processing section 41 and a command-output section 42.

A density-sensor-controller 35 connected to the density sensor 31 puts a degree of density measured by the density sensor 31 into the computation-processing section 41.

A preset reference density value is set (stored) in the computation-processing section 41. Each of the reference density values used in multi-color printing conducted by the electronic photograph printer 1 is set in the computation-processing section 41.

The computation-processing section 41 calculates the average of image densities (measured density values) measured by using the density sensor 31 at the image-density-measurement points in the width direction of the web based on the measured density values which have been provided by the density-sensor-controller 35. Subsequently, the difference between the obtained average and the reference density value is calculated, and then, a compensated density value is calculated based on the resultant difference.

The average value for the image densities (measured density values) represents the arithmetic mean of the densities measured at the image-density-measurement points with respect to one of the density-controlling patches 5. Needless to say, the average value is compared with the reference density value associated with color associated with each density-controlling patch 5.

Regarding each corresponding density-controlling patch 5 printed on the web 101 by the corresponding electronic-photograph-printing unit 2, each color undergoes calculation of arithmetic mean and comparison with the reference density value, and then, the compensated density value is calculated.

Reference numeral 244 shown in FIG. 2 indicates a power supply section for putting out (applying) a high voltage of electric current to the developing roll 241 of the developer apparatus 24. The voltage put out from the power supply section 244 is a development bias applied to the photosensitive drum 21 of the developing roll 241.

The command-output section 42 puts out a control signal (control instruction) for controlling the voltage put out from the power supply section 244 based on the compensated density value calculated by the computation-processing section 41.

The control signal put out in a digital signal format is further converted to an analogue signal format by a D/A conversion unit 245, and then put into the power supply section 244.

As shown in FIG. 2, the density-control system in the electronic photograph printer 1 is composed of: the density sensor 31; the density-sensor-controller 35; the density controller section 4; the D/A conversion unit 245; the power supply section 244; the developing roll 241; and the anilox roll 243.

As shown in FIG. 2, the power supply section 244 is connected to the anilox roll 243.

The developing roll 241 and the anilox roll 243 are each made by surrounding a flexible and electrically-conductive surface material such as a conductive urethane rubber around a hard core component made from a metal or the like. The developing roll 241 and the anilox roll 243 making contact with each other have an equal potential with respect to the photosensitive drum 21. Therefore, applying a voltage to the anilox roll 243 causes a voltage of development bias to be applied to the developing roll 241.

Needless to say, in an adoptable configuration, a voltage may be applied from the power supply section 244 to the developing roll 241 directly, i.e., without using the anilox roll 243.

The compensated density value calculated by the computation-processing section 41 is used for controlling the voltage put out from the power supply section 244 so that the density of an image which will be printed on the web 101 by the electronic-photograph-printing units 2 coincide with the reference density value.

Adjusting the voltage put out from the power supply section 244 based on the instruction put out from the density controller section 4 (i.e., controlling the density of an image) allows the density of an image which will be printed on the web 101 by the electronic-photograph-printing units 2 to coincide with the reference density value.

The following is an explanation for a case in which four image density measurement points 311 to 314 as shown in FIG. 3 are set for the density-controlling patch 5 to calculate an arithmetic mean for the measured density values and the compensated density value.

In this case, suppose that D1, D2, D3, and D4 indicate the measured density values corresponding to the four image density measurement points 311 to 314 respectively, and then, an average value of T can therefore be represented as (D1+D2+D3+D4)/4.

A relation of $P=(A-T)\times B$ is effective where P indicates a compensated density value; A indicates a reference density value; and B indicates a computation coefficient.

The computation efficient B herein used is an efficient for converting the difference between the arithmetic mean for the measured image density values and the reference density value into a value of voltage put out from the power supply section 244 (i.e., conversion from image density to voltage).

In addition, the movement for controlling the densities of images corresponding to the plurality of density-controlling patches 5 printed by the electronic photograph printer 1 allows the densities of images printed on the web 101 by the electronic-photograph-printing units 2 to coincide with the reference density values.

As previously explained, the electronic photograph printer 1 controls the densities of images printed on the web 101 by the electronic-photograph-printing units 2 based on the densities of images having been measured at a plurality of points in the width direction of the web 101 by the density sensor 31 so that the average value thereof are equal to the preset reference density values. In this configuration, the densities of the images are controlled based on the densities of the images of the density-controlling patches 5 that have actually been printed on the web 101. Therefore, the present invention ensures more accurate and stable density control than those of conventional cases. For another obtainable advantage, the present invention ensures accurate and stable density control regardless of the properties of liquid toner, the properties of a web, the feeding rate for the web, etc.

In addition, the present invention ensures measurement of densities at more reduced cost than in a case of conventional technology case using a plurality of sensors, since the densities of images are measured by moving the density sensor 31 in the width direction of the web 101 at a plurality of points in the width direction of the web 101. In addition, the present invention can facilitate setting of the measurement positions in accordance with various printing conditions including printing width and printing quality or the like since measurement of densities using the density sensor moving in the width direction of the web 101 enables arbitrary setting of the measurement positions (image-density-measurement points) in the width direction of the web 101. Therefore, the number of image-density-measurement points in the width direction of the web 101 can be set arbitrarily. Furthermore, reliable density measurement can be conducted in accordance with various printing conditions including printing width and printing quality or the like.

Although the present invention has been described with respect to its preferred embodiments, the present invention is not limited to the embodiments described above. The configuration of the present invention allows for addition, omission, substitution and further modification without departing from the spirit and scope of the present invention.

The web for use in the present invention, not limited to a swathe of elongated paper, may be in a flat sheet format. For example, adoptable formats of flat sheets include the A3 format, or the A4 format or the like that is finished in accordance with Japan Industrial Standard (JIS), and untrimmed format.

The supplied quantity of flat sheets can be calculated by using a paper-quantity counter.

Furthermore, the present invention, not limited for use in a multi-color electronic photograph printer, can be used for a mono-color electronic photograph printer.

In addition, the present invention is not limited to the electronic photograph printer having a function of printing the density-controlling patches. An electronic photograph printer free from the function of printing the density-controlling patches may be capable of controlling the densities of images at the plurality of points in the width direction of the web 101 by using the density sensor provided in the density-measurement section while using a mono-color section found on the web as the density-controlling patch.

What is claimed is:

1. A multi-color-liquid-toner electronic photograph printer, comprising:

electronic-photograph-printing units for printing images on a web;

a density sensor for measuring densities of images printed by the electronic-photograph-printing units at a plurality of points in a width direction of the web at downstream in the feeding direction of the web relative to the electronic-photograph-printing units;

a density-measurement section for moving the density sensor in the width direction of the web; and a density controller section for comparing an average value for the densities of the images measured by the density sensor with preset reference density values, and for causing the densities of images which are about to be printed on the web by the electronic-photograph-printing units to coincide with the reference density values.

2. The electronic photograph printer according to claim 1, further comprising a sensor-movement-control section for controlling driving states of the electronic-photograph-printing units, wherein the density-measurement section is capable of setting a plurality of image-density-measurement points, at which the density sensor suspends its sensing movement, at the plurality of points in the width direction of the web in accordance with an instruction put into the sensor-movement-control section, and moves the density sensor in the width direction of the web while ensuring that the density sensor suspends its sensing movement for a preset suspension time at each image-density-measurement point.

3. The electronic photograph printer according to claim 2, further comprising an operation terminal for inputting an instruction for setting the plurality of image-density-measurement points and for supplying the instruction to the sensor-movement-control section.

4. The electronic photograph printer according to claim 3, wherein the sensor-movement-control section has an automatic function of setting the image-density-measurement points in accordance with a printing width with which the electronic-photograph-printing units are currently printing.

5. The electronic photograph printer according to claim 2, wherein the sensor-movement-control section has an automatic function of setting the image-density-measurement points in accordance with a printing width with which the electronic-photograph-printing units are currently printing.

6. The electronic photograph printer according to claim 1, wherein one of the electronic-photograph-printing units prints a band-shaped density-controlling patch extending in the width direction of the web, and the density-measurement section controls the densities of images which are about to be printed on the web by the electronic-photograph-printing units in accordance with the densities of the density-controlling patches measured by the density sensor at the plurality of points in the width direction of the web.

7. A printing method using the electronic photograph printer of claim 1, the method comprising:

setting the reference density value for each color;

printing each color of the density-controlling patch so that the density-controlling patches are shifted with respect to the longitudinal direction of the web;

measuring the density of each color of the corresponding density-controlling patch by using the density sensor at the plurality of points in the width direction of the web; and controlling the density of each color which is about to be printed on the web by the corresponding electronic-photograph-printing unit by using the density-measurement section so that the average value for the image densities measured by the density sensor is equal to the preset reference density value.

8. The printing method according to claim 7, further comprising:

printing the density-controlling patches automatically when the quantity of the web supplied to the electronic-photograph-printing units reaches a preset value; and suspending the printing operation automatically after the density-controlling patches have been printed.

9. The printing method according to claim 8, further comprising measuring the densities of the images automatically by using the density sensor after the density-controlling patches have been printed.

* * * * *